United States Patent [19]

Cuschera

[11] Patent Number: 4,780,915

[45] Date of Patent: Nov. 1, 1988

[54] TOILET FLOOR FLANGE

[76] Inventor: Casper Cuschera, 967 Industrial Parkway West, Hayward, Calif. 94544

[21] Appl. No.: 126,208

[22] Filed: Nov. 27, 1987

[51] Int. Cl.[4] ..... E03D 11/00

[52] U.S. Cl. ..... 4/252 R

[58] Field of Search ..... 4/252 R, 288; 285/58, 285/56

[56] References Cited

U.S. PATENT DOCUMENTS

| | | | |
|---|---|---|---|
| 1,521,645 | 1/1925 | Panovi | 4/252 R |
| 3,015,501 | 1/1962 | Minella | 4/252 R X |
| 3,311,391 | 3/1967 | Harrell | 4/252 R X |
| 3,319,268 | 5/1967 | Blumenkranz | 4/252 |
| 3,409,918 | 11/1968 | Gaddy | 4/252 R |
| 3,952,340 | 4/1976 | Cuschere | 4/252 R |
| 4,090,267 | 5/1978 | Cuschera | 4/288 |
| 4,207,630 | 6/1980 | Bressler | 4/252 R |
| 4,637,079 | 1/1987 | Hodge | 4/252 R X |
| 4,648,139 | 3/1987 | Stokes | 4/252 R |

*Primary Examiner*—Lenard A. Footland

*Attorney, Agent, or Firm*—Harris Zimmerman; Howard Cohen

[57] ABSTRACT

A floor flange for coupling the outlet of a toilet to a drainpipe which extends through the floor beneath the toilet has a sleeve member can be fitted on to the upper end of the drain pipe and has a flange member with a central opening through which the sleeve member extends. Screw passages enable the flange member to be secured to the floor and bolt passages provide for securing the toilet base to the flange. The flange member has a rectangular outline and in the preferred form is at least as broad as the base of the toilet. The flange configuration facilitates toilet installations as the openings which must be cut in the subjacent flooring need not be circular.

3 Claims, 2 Drawing Sheets

TOILET FLOOR FLANGE

TECHNICAL FIELD

This invention relates to plumbing fittings and more particularly to floor flanges or closet flanges of the type used to couple the outlet of a toilet to a drainpipe and to secure the toilet to a floor.

BACKGROUND OF THE INVENTION

The base of a toilet must be secured in place over an opening in a floor into which the upper end of a drainpipe extends and the waste outlet of the toilet must be communicated with the drainpipe in a leak proof manner. In order to realize both of these objectives, a form of fitting known as a floor flange or closet flange is secured to the drainpipe. The flange is fastened to the floor with screws or the like and the toilet is secured to the flange by bolts or other means.

The floor flange has an inner sleeve-like member which is fitted onto the upper end of the drainpipe and bonded to the pipe with solvent or solder depending on the materials of which the drainpipe and flange are made or which, in some cases, is clamped to the drainpipe by resilient sealing devices. An annular flange member extends outward from the sleeve and contacts the adjacent portions of the upper surface of the floor. Passages and slots in the flange member receive the screws and bolts which fasten the flange to the floor and secure the toilet base to the flange. The flange member is preferably rotatable relative to the sleeve to facilitate alignment of the slots with the bolt holes in the toilet base after the sleeve has been secured to the drainpipe The toilet base has a large concavity bounded by front, back and sidewall portions of the base which extend downward to carry the weight of the toilet. Prior closet flanges have been designed to fit within this concavity and to be straddled by the sidewalls of the toilet base which rest directly on the floor. Thus the prior floor flanges are not required to support any of the weight of the toilet.

This traditional construction causes a significant complication in the installation of toilets that has not heretofore been recognized or addressed. In particular, the prior floor flange design makes it necessary that the opening which is cut through the floor to receive the drainpipe and flange be a circular one. The diameter of the flange is limited by the requirement that it not exceed the width of the concavity in the base of the toilet. Consequently, a square opening would not provide for an adequate amount of overlap of the floor surface by the flange. Much of the flange portion of the fitting would be resting over empty space. This would concentrate stresses at four limited areas of the flange member and severely restrict the space available for the screws which attach the flange to the floor.

Forming circular openings in flooring material is more difficult and time consuming than cutting rectangular openings. It would be advantageous if the floor flange construction was seatable over non-circular openings in the flooring and provided for more relaxed tolerances with respect to the dimensions and location of the openings.

The present invention is directed to overcoming one or more of the problems discussed above.

SUMMARY OF THE INVENTION

In one aspect, the present invention provides a floor flange for coupling the outlet of a toilet base to a drainpipe, the floor flange having a sleeve member proportioned to fit on the upper end of the drainpipe and having a substantially flat flange member with a circular opening into which the the sleeve member extends. The flange member has a first plurality of passages for enabling attachment of the flange to a floor and has a second plurality of passages which enable attachment of the toilet base to the flange. The flange member has a substantially rectangular outline.

In another aspect of the invention, the flange member is proportioned to be at least as broad as the toilet base.

In a further aspect, the invention provides a floor flange for interconnecting the outlet of a toilet with a drainpipe located at the floor beneath the toilet, the toilet having a base with downwardly extending front, back and side wall portions that support the toilet. The floor flange includes a cylindrical sleeve proportioned to engage the drainpipe, in coaxial relationship with the pipe, the sleeve having an annular lip which extends radially outward at the top of the sleeve. A flange member has a circular opening through which the sleeve extends and which is of smaller diameter than the lip of the sleeve. The flange member has substantially linear opposite edges which are spaced apart a distance at least equal to the width of the toilet base to enable the flange member to extend under the sidewall portions of the toilet base. The flange member includes means for enabling fastening of the toilet base to the flange and fastening of the flange member to a floor.

In still another aspect, the invention provides a floor flange connecting the outlet of a toilet to a drainpipe which extends through the floor below the base of the toilet, t e toilet base having front and back wall portions and opposite sidewall portions. A cylindrical sleeve is fitted onto the upper end of the drainpipe beneath the toilet, in coaxial relationship with the drainpipe and has an annular lip which extends outward from the upper end of the sleeve. A flange member has a central opening through which the upper end of the sleeve extends, the opening being of smaller diameter than the lip of the sleeve and upper surface of the flange member being abutted against the under side of the lip in the region of the opening. A plurality of vertical passages extend through the flange member. The flange member is rectangular and has edge regions which extend between the floor and the back wall portion of the toilet base and between the floor and at least the back part of the side wall portions of the toilet base. First fasteners extend through a first group of the vertical passages and into the floor and second fasteners extend through another group of the passages to secure the toilet to the flange member.

The invention simplifies and expedites the installation of toilets by avoiding the need for a circular drainpipe passage through the floor beneath the toilet. The opening may, for example, be a square one which can be more easily cut through the flooring with a power saw or other tool. The drainpipe passage need not be as precisely formed as has heretofore been advisable as the invention enables a substantially greater overlap of the floor flange with the flooring surface.

Other aspects and advantages of the invention will be apparent from the following description of a preferred embodiment.

DETAILED DESCRIPTION OF A PREFERRED EMBODIMENT

Figure 1:
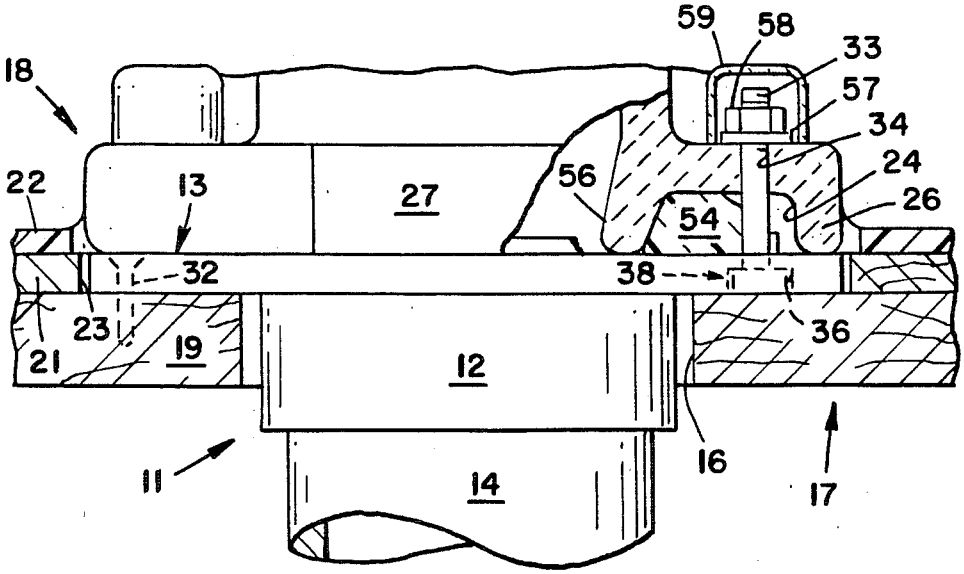
FIG. 1 is an elevation view of a floor flange in accordance with a preferred embodiment of the invention as utilized to couple the base of a toilet to a drainpipe, the view being taken from the back of the toilet and being partially in section.

Referring initially to FIG. I of the drawings, a toilet floor flange 11 embodying the invention has a cylindrical sleeve member 12 and an essentially flat flange member 13 which is disposed in coaxial relationship with the sleeve member. The sleeve 12 is proportioned to be fitted onto the upper end of a closet bend or similar drainpipe 14 that extends up into an opening 16 in the floor 17 beneath a toilet base 18.

While the floor 17 may be concrete or other materials in some cases, most bathroom floors typically have a composite construction which includes an underlayer of floorboards 19 or wooden planking. Floorboards 19 are covered by a thinner intermediate layer of plywood 21 or the like. An upper layer 22 of tile, linoleum or the like is adhered to the plywood 21. In the prior practice, the floor opening 16 extends through both the floorboard 19 layer and the plywood 21 layer and the underside of the flange member 13 rests on the plywood. The flange member 13 of the present invention is designed to rest on the lower layer of floorboards 19. A broader opening 23, having an outline conforming to the outline of flange member 13, is formed in the plywood 21 to receive the flange member which preferably has a thickness similar to that of the plywood.

Toilet bases 18 typically have a concavity 24 bounded by opposite side wall portions 26, a back wall portion 27 and a front wall portion (not shown) which extend downward to support the weight of the toilet. The flange members 13 of prior floor flanges have been circular and sufficiently small in diameter to fit within the concavity 24 in the base 18 of a standardized toilet. In the prior practice, the wall portions 26, 27 of the toilet base 18 rested on the plywood 21 or the like and thus the floor flange does not bear any of the weight of the toilet. The present floor flange 11 is distinct in that the flange member 13 is proportioned to be broader than the concavity 24 of the toilet base 18. Thus the flange member 13 extends under the wall portions 26 and 27 in the back region of the toilet base 18 and the back portion of the toilet rests on the flange member rather than on the flooring 17.

Figure 2:
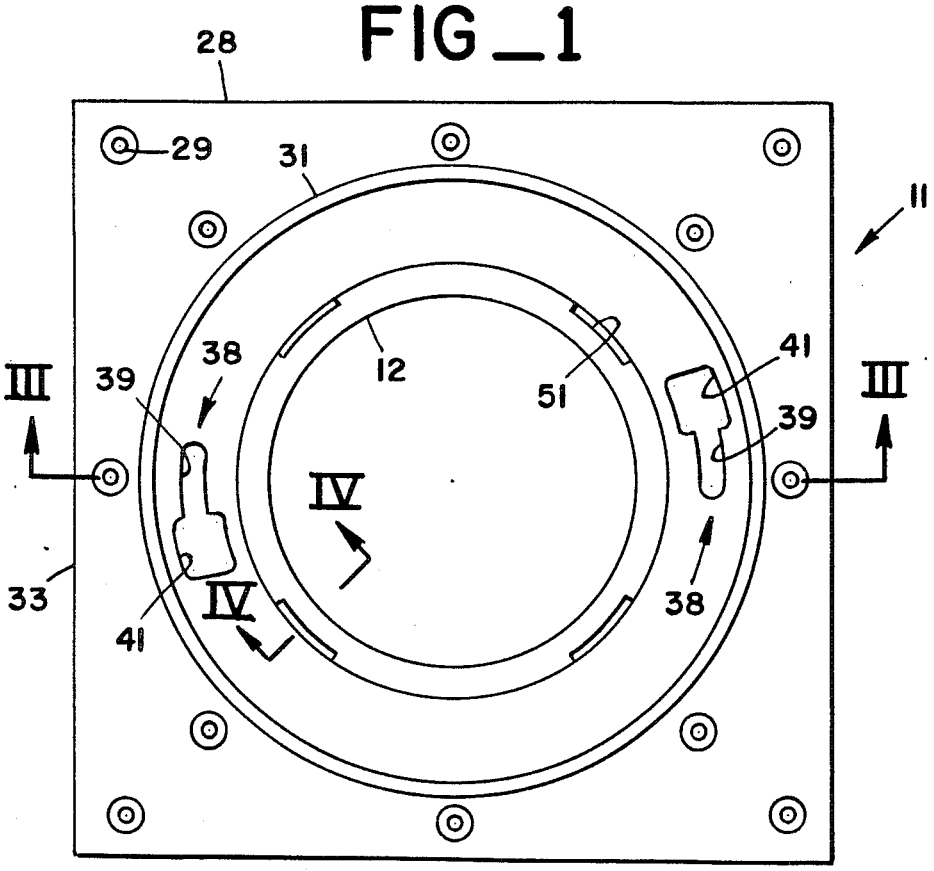
FIG. 2 is a plan view of the floor flange of FIG. 1.

Referring jointly to FIGS. 1 and 2, flange member 13 has a rectangular, preferably square, outline and in the preferred form, the edges 28 of the member each have a length substantially the same as the width of the standard toilet base 18.

The flange member is transpiered by a plurality of countersunk passages 29 for receiving screws 32 which secure the member to floor 17, such passages preferably being distributed along each edge 28 region of the member including at the corners with others of the passages being adjacent a circular raised rib 31 which is on the upper surface of the member and which will hereinafter be further discussed.

Figure 3:
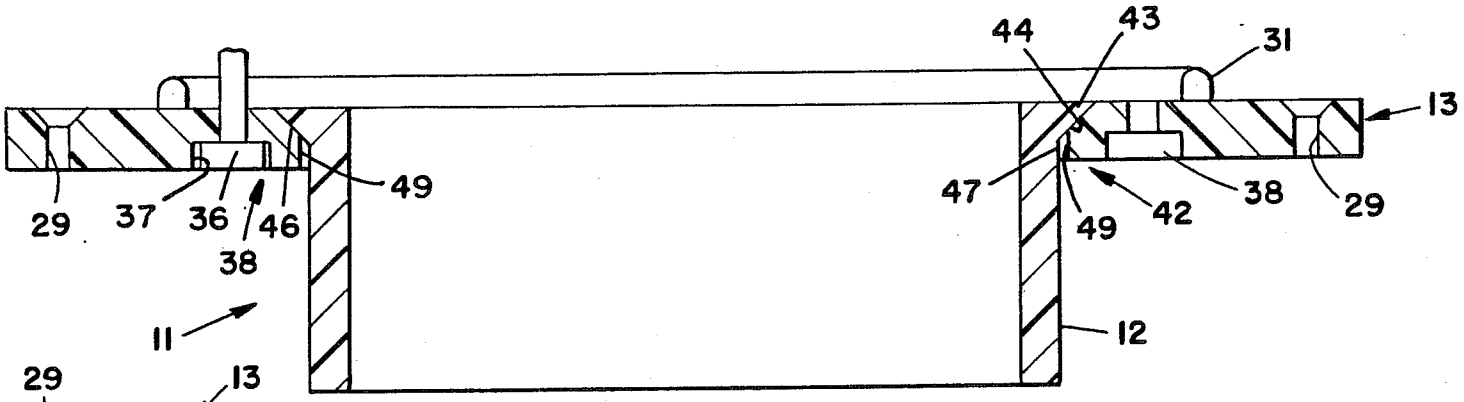
FIG. 3 is an elevation section view of the floor flange of the preceding figures. Taken along line III—III of FIG. 2.

A pair of arcuate slot passages 38 are formed in the flange member 13 to receive the two hold-down bolts 33 which secure the toilet base 18 to the member. Passages 38 are at opposite side regions of the flange member 13 at locations corresponding to those of the hold-down bolt passages 34 of a standard toilet base 18. The curved passages 38 extend along segments of a circle that is concentric with the central opening 47 of the flange member 13 and each such passage has a narrow slot region 39 at one end and a broader region 41 at the other end. Thus the bolts 33 may be engaged in the passages 38, after the flange member has been secured to floor 17, by inserting the enlarged heads 36 of the bolts into the broad regions 41 of the passages and then translating the bolts into the narrower slot regions 39 of the passages to locations corresponding to those of the bolt passages 34 of toilet base 18. Referring now to FIGS. 2 and 3 in conjunction, the underside of the flange member 13 has a circular recess 37 which extends below each passage 38 to receive the bolt heads 36 and thus the bolt heads need not extend below the flange member 13.

With reference to FIG. 3, the sleeve 12 and flange member 11 can in some instances be a single integral element but it facilitates installation if the the flange member is turnable relative to the sleeve as the bolt receiving passages 38 can then be adjusted to the proper location after the sleeve has been secured to a drainpipe. It is also advantageous if the sleeve 12 is separable from the flange member 13. This enables substitution of sleeves 12 of different lengths or configuration at installations where the size or location of the drainpipe makes that necessary.

Figure 4:
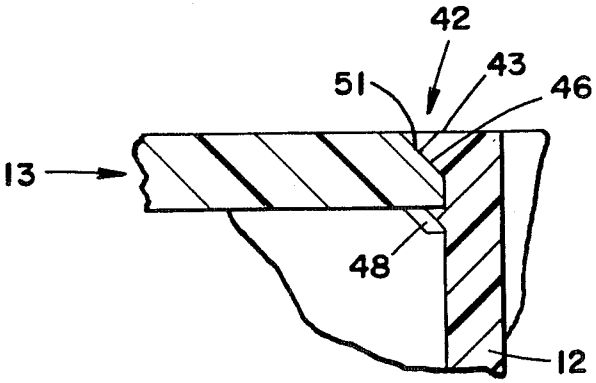
FIG. 4 is an elevation section view of a portion of the floor flange taken along line IV—IV of FIG. 2.

Means 42 for attaching the sleeve 12 and flange member together in a relatively rotatable and disengagable manner include an annular lip 43 integrally formed at the upper end of the sleeve and which has a slanting undersurface 44. Lip 43 seats against a conforming annular shelf 46 of the flange member 13 that extends around the upper end of the circular central opening 47 of the flange member. Referring jointly to FIGS. 2 and 4, four small tab projections 48 extend a short distance inward from the inner surface of sleeve 12 just below the underside of shelf 46, the tabs being equiangularly spaced apart around the sleeve surface. Thus lip 43 and tabs 48 normally hold the sleeve 12 and flange member 13 toqether while enabling rotation of one member relative to the other. Shelf 46 has four equiangularly spaced notches 49 which conform in size to the sleeve tabs 48. Thus the sleeve 12 may be withdrawn from the flange member opening 47 if it is rotated to bring the tabs 48 to the locations of the notches 49. Another sleeve 12 may be engaged with the flange member 13 by reversing the procedure. Registering of the tabs 48 of the sleeve 12 with notches 49 of flange member 13 is facilitated by four additional notches 51 in lip 43 each being situated above a separate one of the tabs. The tabs 48 are visible through notches 51 when the tabs are directly under notches 49 in position to enable separation of the sleeve 12 and flange member 13.

Figure 5:
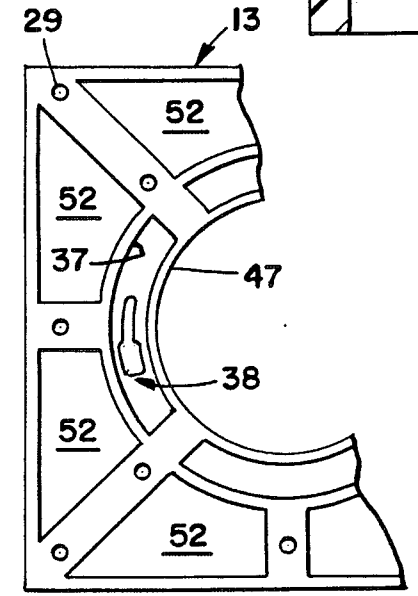
FIG. 5 is a view of the underside of the flange member of the floor flange of the preceding figures.

The sleeve 12 and flange member 13 are formed of plastic in this embodiment although one or both of such elements may also be metal. Referring now to FIG. 5, a high strength but light and economical construction can be realized by providing recessed regions 52 in the underside of flange member 13 at locations away from the screw passages 29, hold-down bolt notches 38 and the inner and outer edge regions of the member.

Referring to FIGS. 2 and 3, the raised circular rib 31 on the top surface of flange member 13 is coaxial with sleeve 12 but of larger diameter and aids in retaining wax sealing material as will be further discussed.

During installation, with reference again to FIGS. 1 and 2, openings 16 and 23 are cut into floorboards 19 and plywood 21 respectively. In contrast to the prior practice the openings 16 and 23 may be of square configuration and thus are quickly and easily cut by using a power saw of the type which enables adjustment of the depth of cut or other similar tool. Normally, four straight cuts with the saw or the like are all that is required to form each opening 16, 23.

The drainpipe 14 is then installed in the conventional manner with the upper end of the pipe being within floor opening 16. Sleeve 12 of the floor flange 11 is fitted onto the upper end of the drainpipe 14 and bonded to the pipe such as with solvent in the case of plastic components or solder if the pipe and floor flange are metal. Flange member 13 then rests on floorboards 19, within opening 23 and is secured in place with screws 32. The heads 36 of hold-down bolts 33 are engaged with passages 38 as previously described.

A wax gasket 54 having a thick annular body of deformable wax is then fitted onto the annular horn 56 which forms the waste outlet of the toilet. Toilet base 18 is then lowered onto the floor flange 11 with bolt passages 34 being in alignment with the hold-down bolts 33. The toilet base 18 is then secured to the floor flange 11 by engaging washers 57 and nuts 58 on the hold-down bolts 33 which elements may be concealed by decorative caps 59 if desired.

Lowering of the toilet base 18 results in compression of the wax gasket 54 which then deforms somewhat to provide a water-tight seal between toilet horn 56 and the sleeve 12 of the floor flange 11. Rib 31 acts to resist spreading of the wax gasket 54 and thus aids in providing a thorough and durable seal.

While the invention has been described with respect to a single embodiment for purposes of example, many modifications and variations in the construction are possible and it is not intended to limit the invention except as defined in the following claims.

I claim:

1. In conjunction with a floor structure having a frame assembly, a sub-floor secured to the upper surface of the frame assembly, and a floor surface material secured to the upper surface of the sub-floor, a floor flange connecting the outlet of a toilet to a drainpipe which extends through the floor structure below the base of said toilet, said toilet base having front front and back wall portions and opposite side wall portions, comprising:

a cylindrical sleeve fitted onto the upper end of said drainpipe beneath said toilet in coaxial relationship with said drainpipe and having an annular lip which extends outward from the upper end of the sleeve, a flange member having a central opening through which said upper end of said sleeve extends, said central opening having a diameter smaller than said lip of said sleeve, said flange member being rectangular and having edge regions which extend between said floor frame assembly and said back wall portion of said toilet base and between said floor frame assembly and at least the back part of said side wall portions of said toilet base, said flange member having a thickness dimension substantially equal to the thickness of said sub-foor and being adapted to be received in a rectangular recess in said sub-floor in flush relationship therewith, said flange member having means for enabling fastening of said toilet base thereto and fastening of said flange member to said floor frame assembly.

2. The floor flange of claim 1 wherein said flange member has a raised circular ridge on the upper surface thereof, said ridge being coaxial with said opening and being or sufficient diameter to be spaced apart from the edge of said opening.

3. The floor flange of claim 1 wherein said flange member is square and each of the edges of said flange member have a length substantially the same as the width of said toilet base.

* * * * *